United States Patent [19]

Cosenza

[11] Patent Number: 4,486,986

[45] Date of Patent: Dec. 11, 1984

[54] FOUNDATION DRAIN SYSTEM

[76] Inventor: Michael A. Cosenza, 325 S. LaSalle, Hobart, Ind. 46342

[21] Appl. No.: 473,694

[22] Filed: Mar. 9, 1983

[51] Int. Cl.[3] ..... E02D 19/00; E04D 17/00

[52] U.S. Cl. ..... 52/169.5; 52/293; 52/303; 405/36; 405/229

[58] Field of Search ..... 52/169.5, 169.6, 209, 52/302, 303, 503, 504, 505, 606, 607, 609, 169.11, 169.12, 169.14, 293; 98/29, 32; 405/36, 43, 45, 229; 210/293

[56] References Cited

U.S. PATENT DOCUMENTS

| | | | |
|---|---|---|---|
| 1,523,977 | 1/1925 | Pillar | 52/303 |
| 1,753,776 | 4/1930 | De Vilbiss | 52/608 |
| 1,773,417 | 8/1930 | Whitacre | 405/43 |
| 1,883,468 | 10/1932 | Barbour | 210/293 |
| 2,046,298 | 6/1936 | Woods | 405/43 |
| 2,147,035 | 2/1939 | Henderson | 52/303 |
| 3,287,866 | 11/1966 | Bevilacqua | 52/169.5 |
| 3,562,982 | 2/1971 | Parezo | 52/169.5 |

FOREIGN PATENT DOCUMENTS

| | | | |
|---|---|---|---|
| 266409 | 11/1968 | Austria | 52/606 |
| 2482160 | 11/1981 | France | 52/303 |

*Primary Examiner*—John E. Murtagh
*Assistant Examiner*—Andrew Joseph Rudy
*Attorney, Agent, or Firm*—Walter Leuca

[57] ABSTRACT

A foundation drain system comprising the combination of a footing, the first course of masonery blocks on the footing having a drain notch for each hollow space on the infacing side of each block. Irregular size and shape stones provided in each of the hollow spaces of the first course of blocks to a level above the notch. A bed of irregular size and shape stones on the interior of the foundation construction contiguous to the footing and to the first course of blocks to a level above the drain notches. A drain tile along the interior perimeter of the footing adjacent thereto in the bed of stones and a discharge pipe connecting the drain pipe extending to the exterior of the foundation.

3 Claims, 6 Drawing Figures

FOUNDATION DRAIN SYSTEM

BACKGROUND OF THE INVENTION

1. Field of the Invention

This invention relates generally to foundation construction for buildings and more particularly to a combination and arrangement of foundation material to facilitate drainage.

2. Description of the Prior Art

Regarding the problem of drainage around the foundation of a structure, it is conventional practice to provide a drain tile buried in the ground surrounding the exterior and adjacent the footing of the structure. Such drain tile is provided with holes or spaces so that water that seeps to the foundation accumulates in the drain tile which is sloped to an exit and thereafter channeled to a storm sewer, an absorption bed or discharged into the ditch if one is available in the proximate vicinity of the building structure. The conventional building foundation generally includes a concrete footing formed in the general shape of a rectangle laid on excavated ground below the frost line for that locale. On the footing are laid courses of concrete building blocks up to ground level or thereabove. These courses form the foundation wall of the structure. My invention is directed to the problem of water accumulation around the footing and the lower part of the foundation wall which the prior art drainage system is not effective in channeling away. This frequently results in the water seeping through the blocks of the foundation and under the footing and accumulating on the inside of the building basement floor necessitating the instalation of a sump pump provided in a well constructed as part of the foundation floor, where the unwanted water is accumulated and from which it may be pumped and externally discharged. This condition occurs when there is an excessive amount of water due to greater amount of rainfall than normal or greater amount of snowfall and thereafter rapid melting so that the exterior drainpipe is incapable of carrying the excess water away allowing the water to seep through the foundation or under the footing and become entrapped within the perimeter of the foundation enclosure.

Though, I am aware of building blocks containing holes for allowing drainage of water therethrough such prior art blocks have not been successful because consideration was not given to the method used in laying the blocks during construction. In laying such blocks, workmen in applying the mortar to the edges of the blocks, drop large amounts of mortar inside the hollow spaces within the blocks accidentally blocking the drain holes. This is generally unavoidable since workmen are generally under pressure to lay as many blocks as possible and their primary objective is providing a good mortar bond between the blocks as rapidly as possible. Obviously, having the additional concern of not allowing accidental dropping of mortar which may block the drain holes provided in the blocks, detract from their prime objective mentioned above. Providing an excess number of drain holes to compensate for the accidental blockage of a few holes would weaken the blocks. Provided a minimum of drain holes which would accomplish proper drainage and not weaken the blocks would not accomplish the proper drainage if a number of the drain holes were accidentally blocked by falling of the excess mortar.

SUMMARY OF THE INVENTION

I have invented a foundation drain system which includes a combination drain tile line, building block course and arrangement of stones that is effective to drain the water away from a building foundation in all situations.

I accomplish excellent drainage by providing a combination of blocks having a minimum of drain openings at the bottom edge of the inside face of the blocks forming the starter course of an enclosure so that the drain openings discharge to the enclosed space of the building structure. The hollow chambers or spaces of the blocks have a quantity of irregular size and shaped stones to a level above the drain openings. A quantity of irregular size and shaped stones are also provided as a bed on the interior side of the footing and foundation to a level above the drain openings in the starter course blocks. A bed of stones covers the drain pipe which is placed below the level of the drain openings adjacent to and around the inside of the structure footing.

Other objects and advantages of this invention will become more apparent after a more careful study of the detailed description thereof which is to be read with references to the accompanying drawings wherein is illustrated a preferred embodiment of this invention.

DETAILED DESCRIPTION OF THE INVENTION

Figure 1:
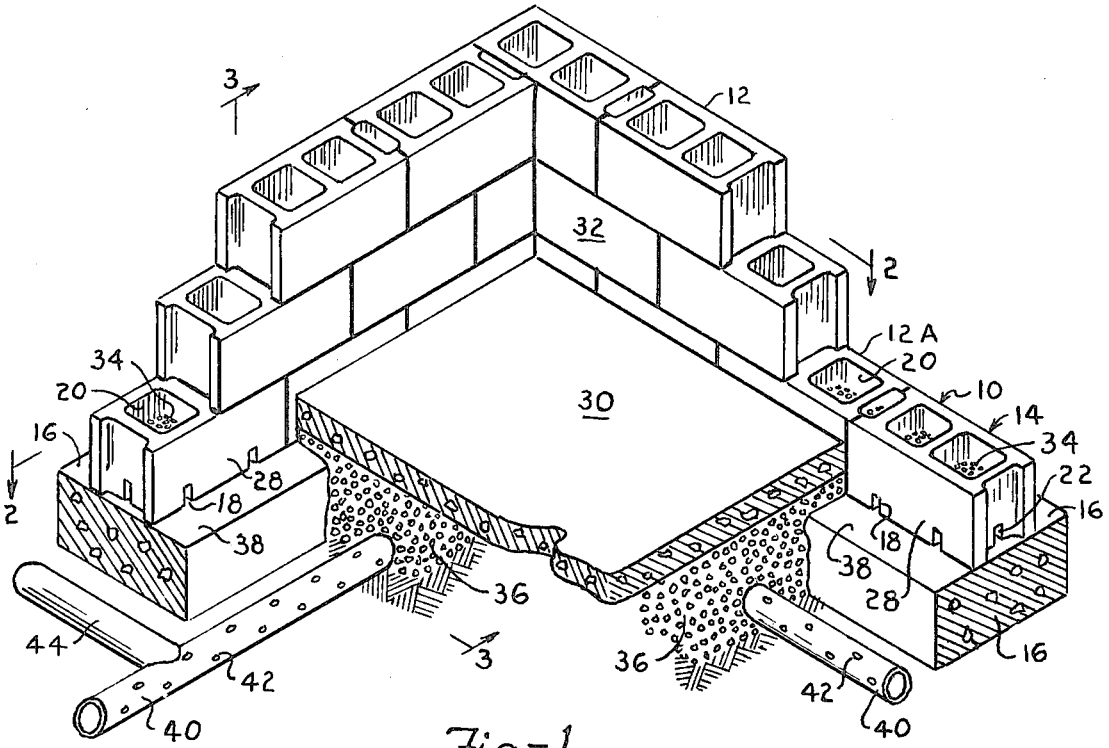
FIG. 1 is a general perspective view in fragment of my construction combination illustrating an inside corner of a concrete footing and block foundation wall.
Figure 2:
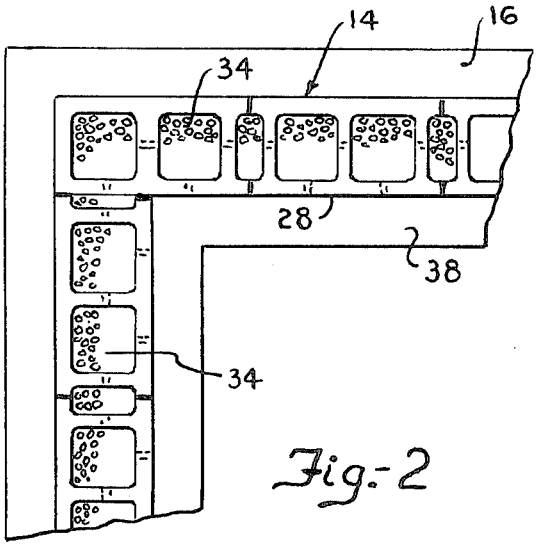
FIG. 2 is a top view of the starter course of blocks showing a portion of the corner structure.
Figure 3:
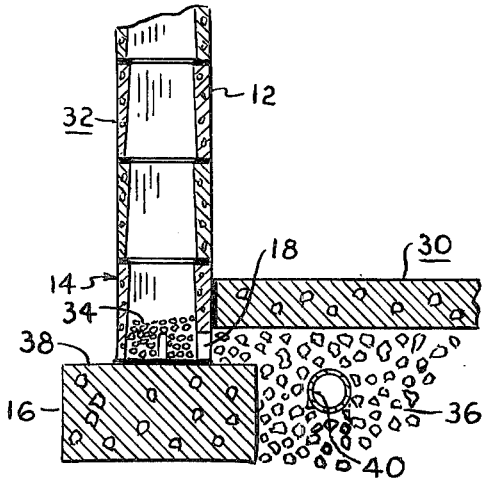
FIG. 3 is an end view of the footing, block foundation wall and the stone drain bed sectioned along lines 3—3 of FIG. 1.
Figure 4:
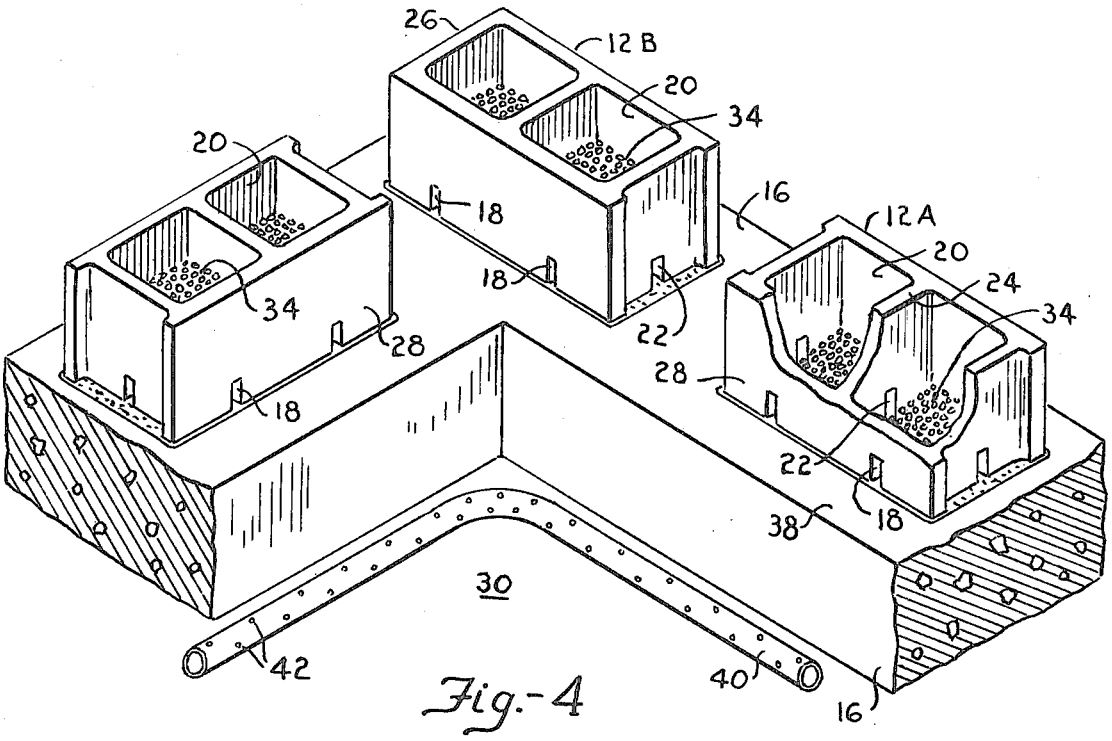
FIG. 4 is an enlarged perspective view in fragment showing parts broken away exposing the hollow spaces of the starter course blocks and the contents thereof.
Figure 5:
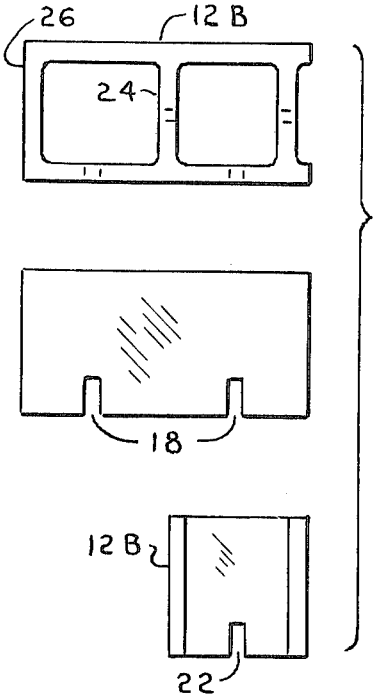
FIG. 5 includes the top view, side view and end view of a corner masonery block formed with drain openings according to the teaching of my invention.
Figure 6:
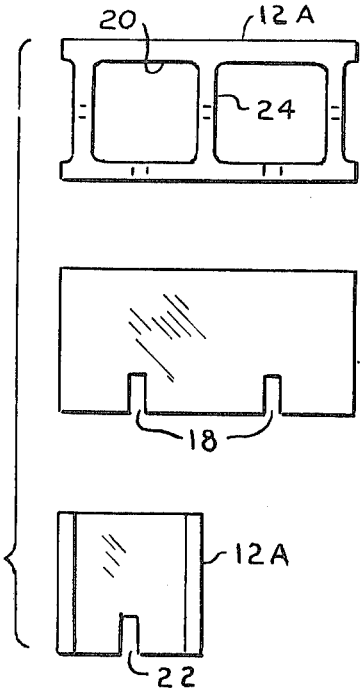
FIG. 6 includes a top view, side view, and end view of an intermediate masonery block formed with drain openings according to the teaching of my invention.

Referring now more particularly to the drawings wherein is illustrated a preferred embodiment of my invention, reference number 10 designates generally the construction combination of my invention. Though I have elected to disclose and describe my invention with references to masonery block construction shown in the drawing as an inside corner of a building structure, it is understood that I am disclosing and describing only a part of the structure to which my invention is applied. I provide a plurality of masonery blocks 12 which normally include intermediate blocks 12A and corner blocks 12B which are well-known to the construction trade. Blocks 12 which are to be used in a starter course 14, that is, the first line of blocks laid on footing 16, are formed with a drain notch 18 for each hollow space or chamber 20 of each block 12. Notches 18 are located adjacent the bottom side of blocks 12. I further provide a drain notch 22 in each partition wall 24 at the ends of the blocks and intermediate the ends of the block excepting the corner block 12B which obviously must have the exposed side 26 solid. These starter course blocks 12 of my invention formed with such drain notches 18 and 22 are laid to form a first course 14 on footing 16 of my construction so that sides 28 of blocks 12 containing drain notches 18 are facing toward the enclosed area 30 of construction 10. Prior to building up on the starter course 14 with additional courses of masonery blocks to form the structure foundation wall 32, I fill each of the hollow chambers 20 of each of the starter course blocks 12 with irregular size and irregular shape stones 34 to a level above the drain notches 18 and 22. My invention further includes as part of the combination, a quantity of stones 36 deposited enmasse as a bed adjacent and against footing 16 on the enclosure side 30 thereof and over the top of footing ledge 38 contiguous to sides 28 of blocks 12 forming starter course 14 to a level above drain notches 18. Provided in stone bed 36 is a continuous run of drain tile 40 positioned adjacent footing 16 extending along the perimeter thereof on the enclosure side 30. Collector drain tile 40 is conventional, having drain holes 42 therethrough for collecting water therein. Connecting the drain tile 40 at an appropriate location is an outlet pipe 44 for discharging the water from drain pipe 40 to the exterior of the structure.

In the operation of my invention, the water which seeps through the ground and through the foundation wall 32 passes unabated through the irregular sized stones 34 provided in the hollow chamber 20 of starter course blocks 12 and pass through drain openings 18 provided on the inside wall 28 of blocks 12. Therefrom, the water will pass through the spaces of the irregular size and shape stones 36 deposited adjacent the inside wall and over footing ledge 38 and work its way to drain tile 40 where it will be collected and channeled away via connecting outlet pipe 44 to a discharge area in the conventional manner.

By providing the drain tile 40 on the inside of the structure enclosure 30 adjacent the footing as above described, all water which collects within the enclosure will be collected by drain tile 40 and be discharged through outlet pipe 44. Consequently, there will be no need for a sump and sump pump for discharging the water which escapes being collected by an exterior drain tile circumscribing the outside of a structure foundation as taught by the prior art. Additionally, the irregular size and shaped stones 34 placed in each hollow 20 of the block starter course 14 will prevent the accidental falling of mortar from remaining solid as would occur when falling on a relatively flat surface and thereby block the drain openings if the mortar were to fall against the openings. I have found that by providing in random fashion, irregular sized stones 34 in block hollow chambers or spaces 20, any mortar falling therein onto the uneven and irregular surfaces of stones 34, will not adhere to the entire surface of the stones but will in-part break up in smaller parts or allow cracks to develop due to the irregular thickness of the mortar mass falling on the irregular surface of the stones. This type of surface prevents any mortar mass from remaining cohesive so as to block the free flow of water through the spaces between stones 34 to drain openings 18 and 22 on its way through stone bed 36 to drain tile 40 to be carried away thereby through outlet pipe 44 to the drain field.

I have further discovered that by locating the drain tile perimeter within the enclosure 30, drain water is more readily directed to it because it is more localized and it is within the enclosure which provides for a dryer bed thereby providing a water flow gradient due to the progressively dryer earth bed. This condition, coupled with accidentially unobstructable drain openings 18 and 22 of foundation blocks 12 provided in the manner of my invention above described, more drain water is collectable and effectively discharged away from a building structure without involving any auxiliary power means such as pumps, as would be required with the method of the prior art.

I claim:

1. In a foundation structure of an enclosure including a footing and a masonery wall thereon wherein said masonery wall includes a hollow masonery course on said footing having holes formed through a side of said course communicating the hollow space of said course and the structure enclosure, the improvement comprising:

a plurality of stones in the hollow space of said course, said stones being at a level above said holes.

2. The combination of claim 1 wherein said stones in the hollow space are further characterized as being irregular in shape and size.

3. A foundation structure for an enclosure including a footing circumscribing an enclosure, a wall on said footing circumscribing said enclosure, a hollow masonery block course on said footing having holes formed through a side of said block course communicating the hollow spaces of said block course and the structure enclosure, a drain conduit within the enclosure of the structure extending adjacent to and along the perimeter of the footing, and having an outlet conduit communicating said drain conduit within the structure enclosure to the structure exterior, and a bed of stones covering said drain conduit, said footing and against said block course to a level above said holes in said block course; wherein the improvement comprises:

a plurality of stones in the hollow spaces of said block course, said stones being at a level above said holes, and said stones being irregular in shape and size.

* * * * *